US006681785B2

(12) United States Patent
Choi

(10) Patent No.: US 6,681,785 B2
(45) Date of Patent: Jan. 27, 2004

(54) WATERPROOF STRUCTURE OF TENT

(76) Inventor: Kyong Jai Choi, 312-301 Beach Apt., 29/5, 148, Namcheon-Dong, Suyoung-ku, Pusan (KR), 613-101

( * ) Notice: Subject to any disclaimer, the term of this patent is extended or adjusted under 35 U.S.C. 154(b) by 0 days.

(21) Appl. No.: 10/095,712

(22) Filed: Mar. 13, 2002

(65) Prior Publication Data

US 2003/0127123 A1 Jul. 10, 2003

(30) Foreign Application Priority Data

Jan. 10, 2002 (KR) ..... 20-2002-0000807

(51) Int. Cl.[7] ..... E04H 15/54

(52) U.S. Cl. ..... 135/115; 135/119; 135/116; 135/137

(58) Field of Search ..... 135/124, 136, 135/137, 116, 115, 119, 120.3, 97, 906, 907

(56) References Cited

U.S. PATENT DOCUMENTS

| | | | | | |
|---|---|---|---|---|---|
| 1,871,570 | A | * | 8/1932 | Weber | 52/3 |
| 3,586,013 | A | * | 6/1971 | Gladden | 135/120.1 |
| 3,863,659 | A | * | 2/1975 | Gillis | 135/136 |
| 4,305,414 | A | * | 12/1981 | Bareis | 135/116 |
| 4,352,362 | A | * | 10/1982 | Nichols | 135/98 |
| 4,665,935 | A | * | 5/1987 | Nichols | 135/125 |
| 5,315,736 | A | * | 5/1994 | Nilsson | 24/115 K |
| 6,334,455 | B1 | | 1/2002 | Nunez, Sr. | |
| 6,338,356 | B1 | | 1/2002 | Wallenstatter | |
| 2002/0000241 | A1 | | 1/2002 | Lee | |

FOREIGN PATENT DOCUMENTS

| | | | | |
|---|---|---|---|---|
| FR | 2672075 | * | 7/1992 | |
| JP | 20002-70366 | * | 3/2002 | |
| WO | WO01/96694 | | 12/2001 | E04H/15/42 |

* cited by examiner

*Primary Examiner*—Winnie Yip
(74) *Attorney, Agent, or Firm*—Jacobson Holman PLLC

(57) ABSTRACT

The present invention relates to a tent, and more particularly, to a waterproof structure of a tent floor corner portion which can obtain a perfect waterproof effect of a tent corner portion by forming a cut hole by cutting away a plurality of corner portions formed by fabric cloth sides and a fabric cloth floor surface of a tent, connecting a tarpaulin corner cloth to the cut hole to be overlapped with each other, attaching overlapped portions by sewing and heat-sealing a plurality of tarpaulin disc members sewn with a webbing tape to the tarpaulin corner cloth, which can manufacture a better-looking tent by differentiating the color of the tarpaulin corner cloth and presenting a variety of peculiar designs, and which can acquire a very economic effect by obtaining a maximum waterproof effect with a minimum amount of an expensive tarpaulin cloth.

5 Claims, 6 Drawing Sheets

WATERPROOF STRUCTURE OF TENT

BACKGROUND OF THE INVENTION

1. Field of the Invention

The present invention relates to a tent, and more particularly, to a waterproof structure of a tent floor corner portion which can obtain a perfect waterproof effect of a tent corner portion by forming a cut hole by cutting away a plurality of corner portions formed by fabric cloth sides and a fabric cloth floor surface of a tent, connecting a tarpaulin corner cloth to the cut hole to be overlapped with each other, attaching overlapped portions by sewing and heat-sealing a plurality of tarpaulin disc members sewn with a webbing tape to the tarpaulin corner cloth, which can manufacture a better-looking tent by differentiating the color of the tarpaulin corner cloth and presenting a variety of peculiar designs, and which can acquire a very economic effect by obtaining a maximum waterproof effect with a minimum amount of an expensive tarpaulin cloth.

2. Description of the Prior Art

FIGS. 1 and 2 shows one example of a conventional tent.

In the conventional tent 1, fabric cloth sides 2 and a fabric cloth floor surface 3 are all made of fiber material.

At a plurality of corner portions formed at the tent 1 made of fiber material, a loop 8 for connecting the tent 1 to a pole is connected.

However, since the loop 8 is made of metal material, it cannot be attached directly to the corner portion of the tent 1, but is attached thereto using a webbing tape 6.

Thus, by sewing the webbing tape 6 to the corner of the tent 1 by a sewing machine, the webbing tape 6 can be attached thereto along a second sewing line 7.

In case of a spiral-wound loop 8, it is connected to the webbing tape 6, or in case of a ring-shaped loop, it is previously connected with the webbing tape 6 before sewing.

However, the above-mentioned conventional art causes a problem that water is leaked to the corner of the tent 1 through the second sewing line 7 in case of rain.

Of course, in the conventional art, an inner cloth 5 covers the inside of the corner portion along a first sewing line 4 as shown in FIG. 2. But, rainwater remaining between the cloth side 2 and cloth floor surface 3 and the inner cloth 5 is not funneled off well. Resultantly, the inside of the tent 1 becomes flooded, thus making it impossible to obtain a perfect waterproof effect.

FIGS. 3 and 4 shows another prior art devised in order to solve the above problems.

The prior art is a technique of attaching sides and a floor surface of a tent 11 made of a PVC tarpaulin material.

That is, a perfect waterproof effect can be obtained by tarpaulin cloth sides 12 and a tarpaulin cloth floor surface 13.

And, at the corner portion which is a border of the tarpaulin cloth sides 12 and a tarpaulin cloth floor surface 13, a tarpaulin disc member 14 is heat-sealed.

In addition, since a webbing tape 15 connecting a loop 17 is attached to the tarpaulin disc member 14 along a sewing line 16 before heat sealing, the loop 17 can be disposed at the corner portion by heat-sealing the tarpaulin disc member 14 to the corner portion.

However, in case of using the cloth sides 12 and cloth floor surface 13 of the tent 1 all made of tarpaulin cloth, it costs a great deal in manufacturing process.

In other words, generally, the tarpaulin cloth is much more expensive than the fabric cloth used for the tent 1, so it is difficult to employ the tarpaulin cloth to the tent 1. Hence, the tarpaulin cloth is being used for only some highest grade products.

SUMMARY OF THE INVENTION

It is an object of the present invention to provide a waterproof structure of a tent floor corner portion which can obtain a perfect waterproof effect of a tent corner portion, which can manufacture a better-looking tent by differentiating the color of the tarpaulin corner cloth and presenting a variety of peculiar designs, and which can acquire a very economic effect by obtaining a maximum waterproof effect with a minimum amount of an expensive tarpaulin cloth.

To achieve the above object, there is provided a waterproof structure of a tent floor corner portion, comprising: a cut hole formed by cutting away a plurality of corner portions formed by fabric cloth sides and fabric cloth floor surface of a tent; a tarpaulin corner cloth overlapping the peripheral portion of the cut hole with its overlapped portion being attached by sewing; and a plurality of tarpaulin disc members to which a webbing tape heat-sealed with the tarpaulin corner cloth is sewn in order to attach the webbing tape connecting a loop by the tarpaulin corner cloth.

BRIEF DESCRIPTION OF THE DRAWINGS

The above-mentioned objects and the feature of the present invention will be more apparent by describing the preferred embodiment of the present invention by referring to the appended drawings, in which.

DESCRIPTION OF THE PREFERRED EMBODIMENT

Figure 2:
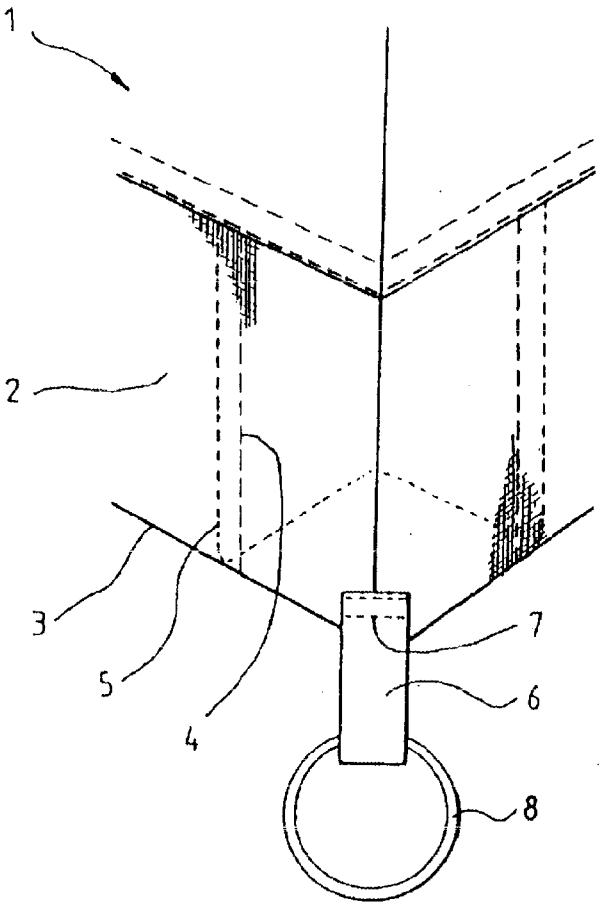
FIG. 2 (PRIOR ART)
FIG. 2 is an expansive view showing the conventional tent floor corner portion of FIG. 1.
Figure 1:
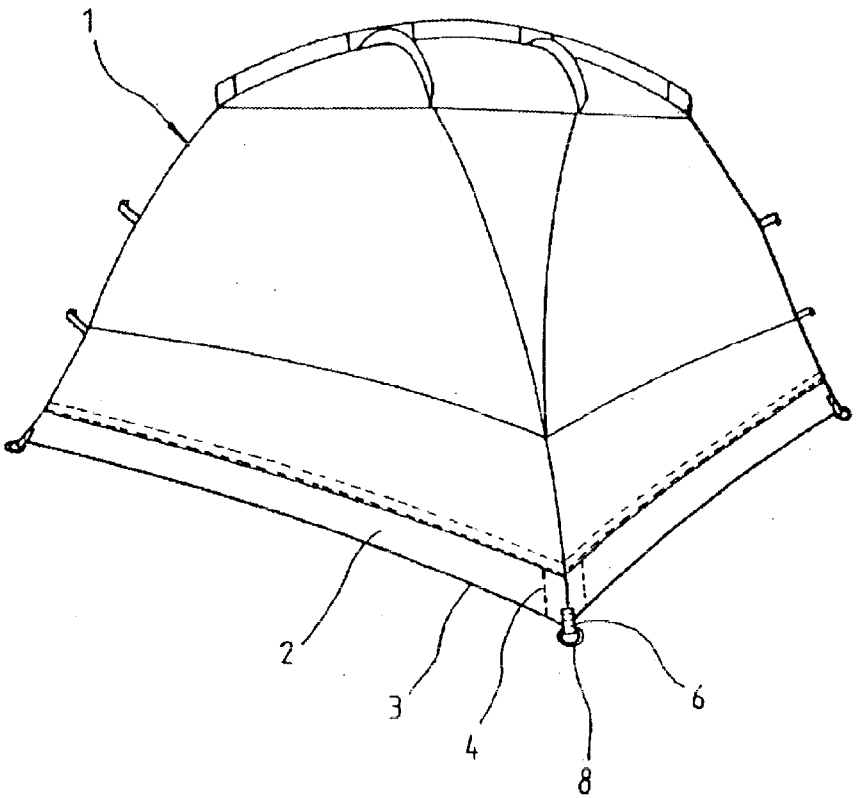
FIG. 1 (PRIOR ART)
FIG. 1 is a perspective view showing a waterproof structure of a tent floor corner portion according to the conventional art.
Figure 4:
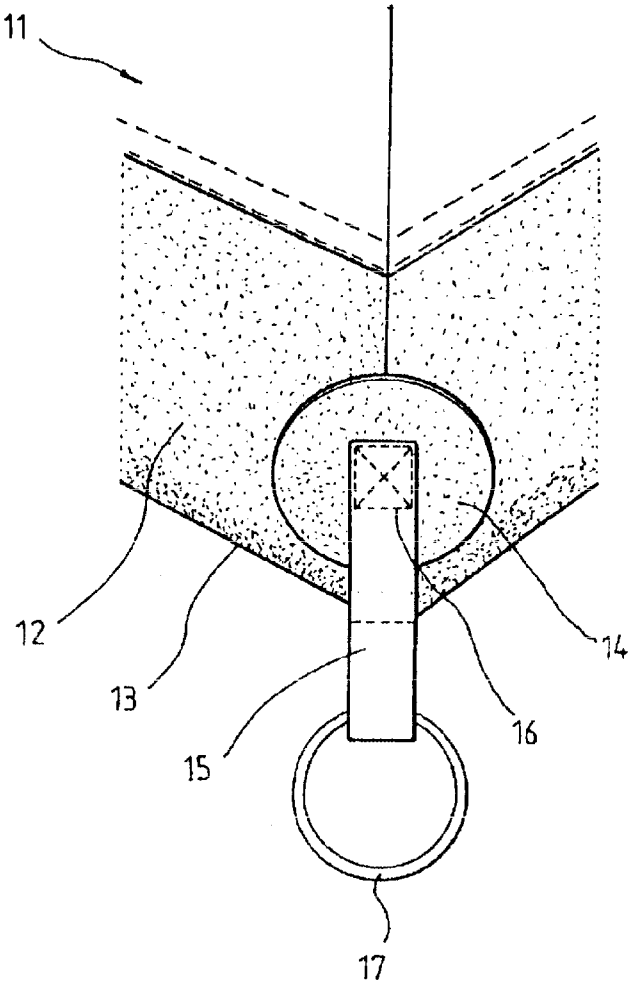
FIG. 4 (PRIOR ART)
FIG. 4 is an expansive view showing the conventional tent floor corner portion of FIG. 3.
Figure 3:
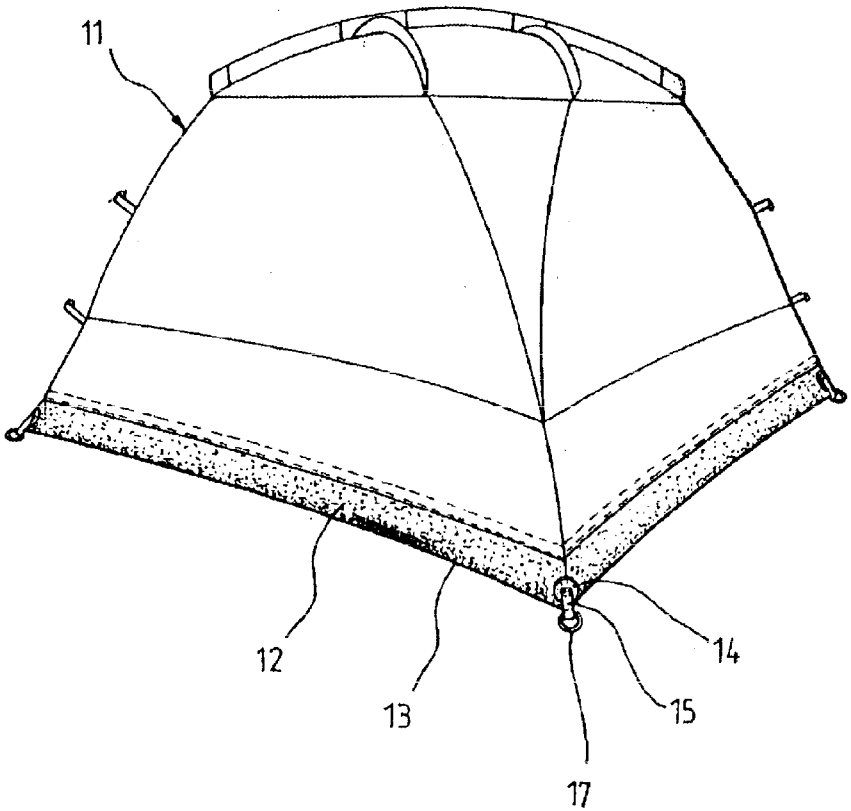
FIG. 3 (PRIOR ART)
FIG. 3 is a perspective view showing another waterproof structure of a tent floor corner portion according to the conventional art.
Figure 5:
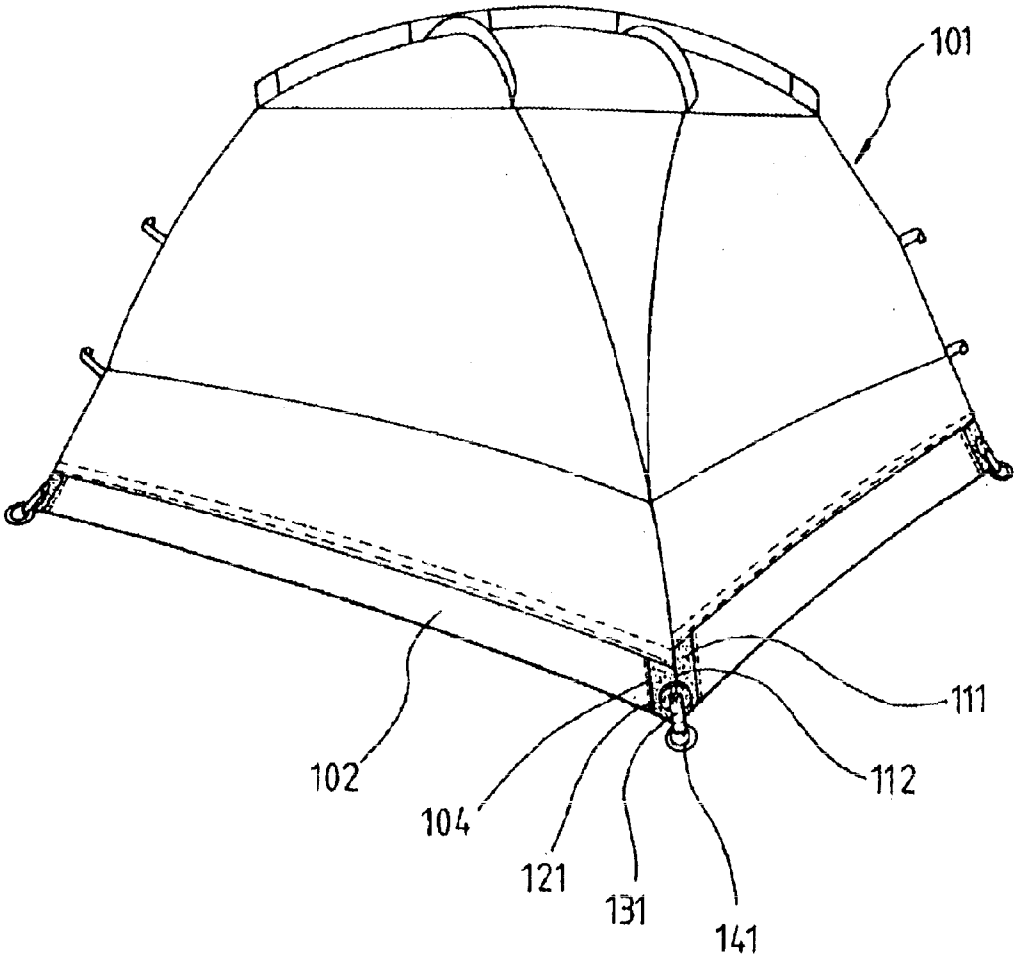
FIG. 5 is a perspective view showing a waterproof structure of a tent floor corner portion according to the present invention.

Hereinbelow, the present invention will be described in greater detail with reference to the accompanying drawings.

A waterproof structure of a tent floor corner portion includes a cut hole 104 formed by cutting away a plurality of corner portions formed by fabric cloth sides 102 and fabric cloth floor surface 103 of a tent 101; a tarpaulin corner cloth 111 overlapping the peripheral portion of the cut hole 104 with its overlapped portion being attached by sewing; and a plurality of tarpaulin disc members 121 to which a webbing tape 131 is sewn is heat-sealed with the tarpaulin corner cloth 111 in order to attach the webbing tape 131 connecting a loop 141 to the tarpaulin corner cloth 111.

In addition, the tarpaulin corner cloth 111 includes a heat seal portion 112 for folding a straight type tarpaulin cloth of a band plate shape to make lateral sides overlapped with each other and heat-sealing overlapped portions; and a tarpaulin floor surface 113 formed naturally by the heat seal portion 112.

The operation of the present invention will now be described.

Firstly, the tarpaulin corner cloth 111 of the present invention is manufactured by the following process.

In other words, the straight type tarpaulin cloth of the band plate shape remained after it is used for another purpose is cut to a predetermined length.

Figure 6:
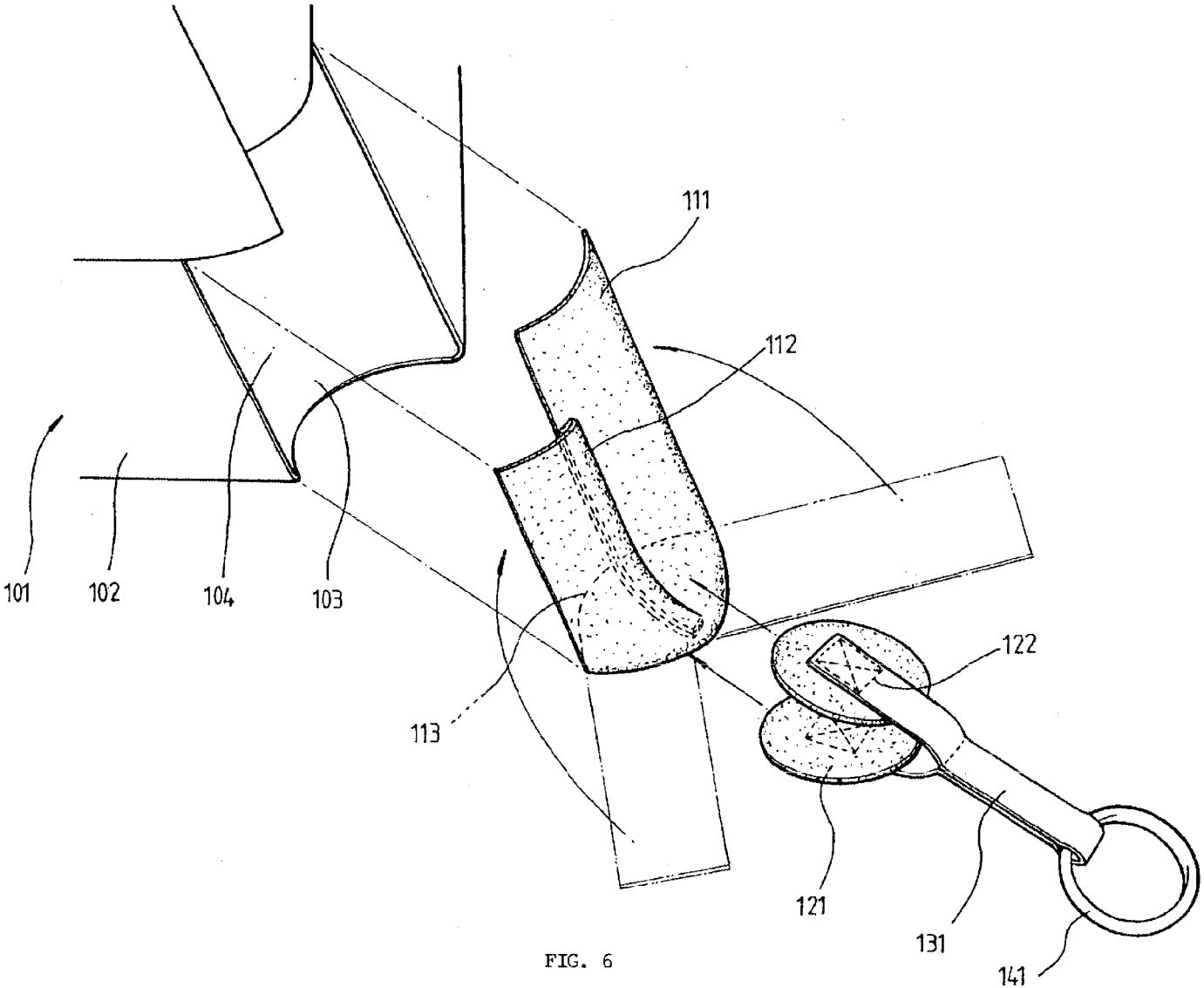
FIG. 6 is a partial perspective view showing the tent floor corner portion according to the present invention.

Then, the cut tarpaulin cloths 111 are folded from an imaginary line to a real line as shown in FIG. 6 to make the lateral sides overlap with each other. When overlapped portions are heat-sealed, the straight type tarpaulin cloth 111 of the band plate shape is made into a basket shape to thereby simultaneously form a tarpaulin floor surface 113. Moreover, at the front surface of the tarpaulin corner cloth 111 and the bottom of the tarpaulin floor surface 113 thus manufactured, a plurality of tarpaulin disc members 121 are heat-sealed.

Of course, in the tarpaulin disc member 121, since the webbing tape connecting the loop 141 is kept in the state that it is previously sewn along a sewing line 122, the loop 141 can be disposed at the corner portions of the tent 101 very conveniently and easily by attaching only the tarpaulin disc member 121 to the front surface of the tarpaulin corner cloth 111 and the bottom of the tarpaulin floor surface 113.

The corner portion, at which fabric cloth sides 102 and a fabric cloth floor surface 103 of the tent 101 meet, is cut such that a cut hole 104 can be formed.

At the cut hole 104 formed at the plurality of corner portions, the tarpaulin corner cloth 111 is connected so that the peripheral portions of the cut hole 104 and tarpaulin cloth 111 can overlap with each other.

Figure 7:
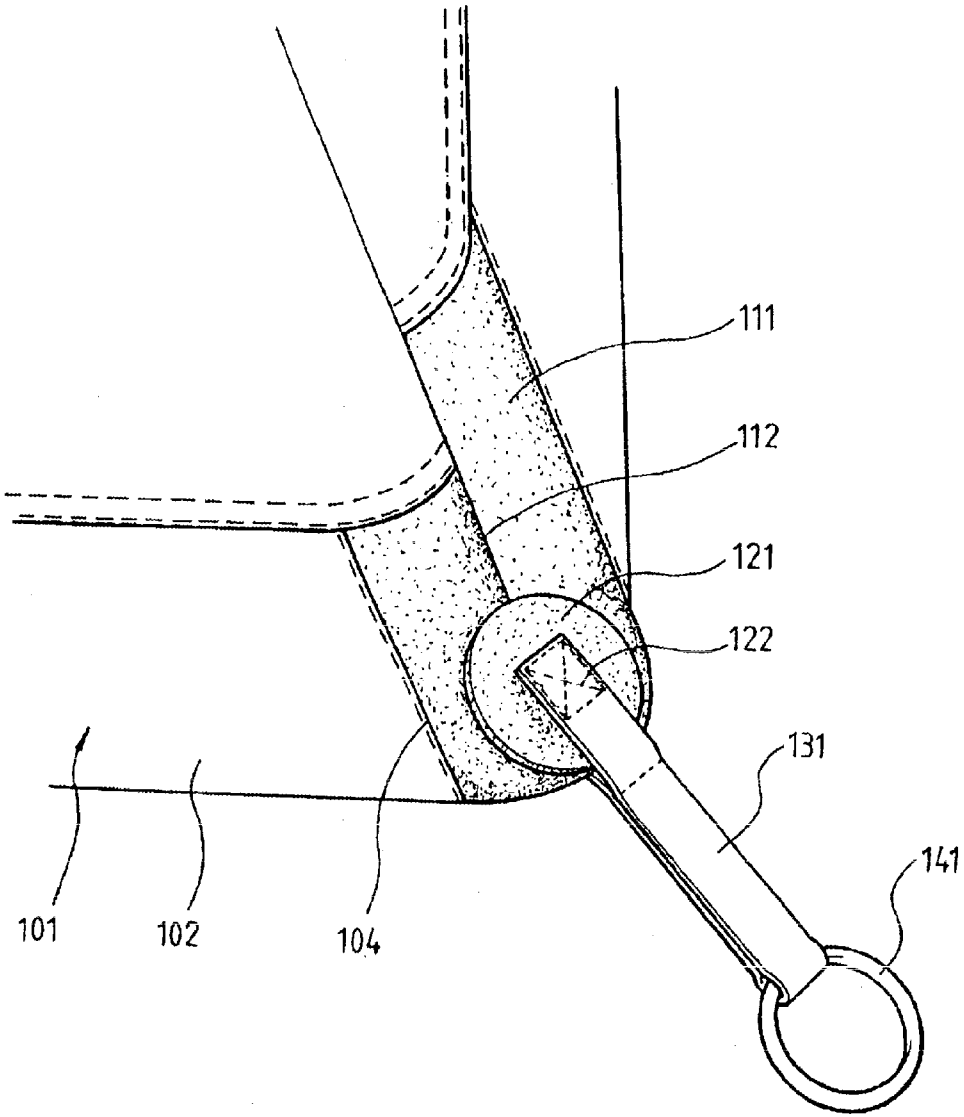
FIG. 7 is a perspective view showing the connected state of the tent floor corner portion according to the present invention.

Then, as shown in FIG. 7, they are fixed by sewing them by a sewing machine.

Figure 8:
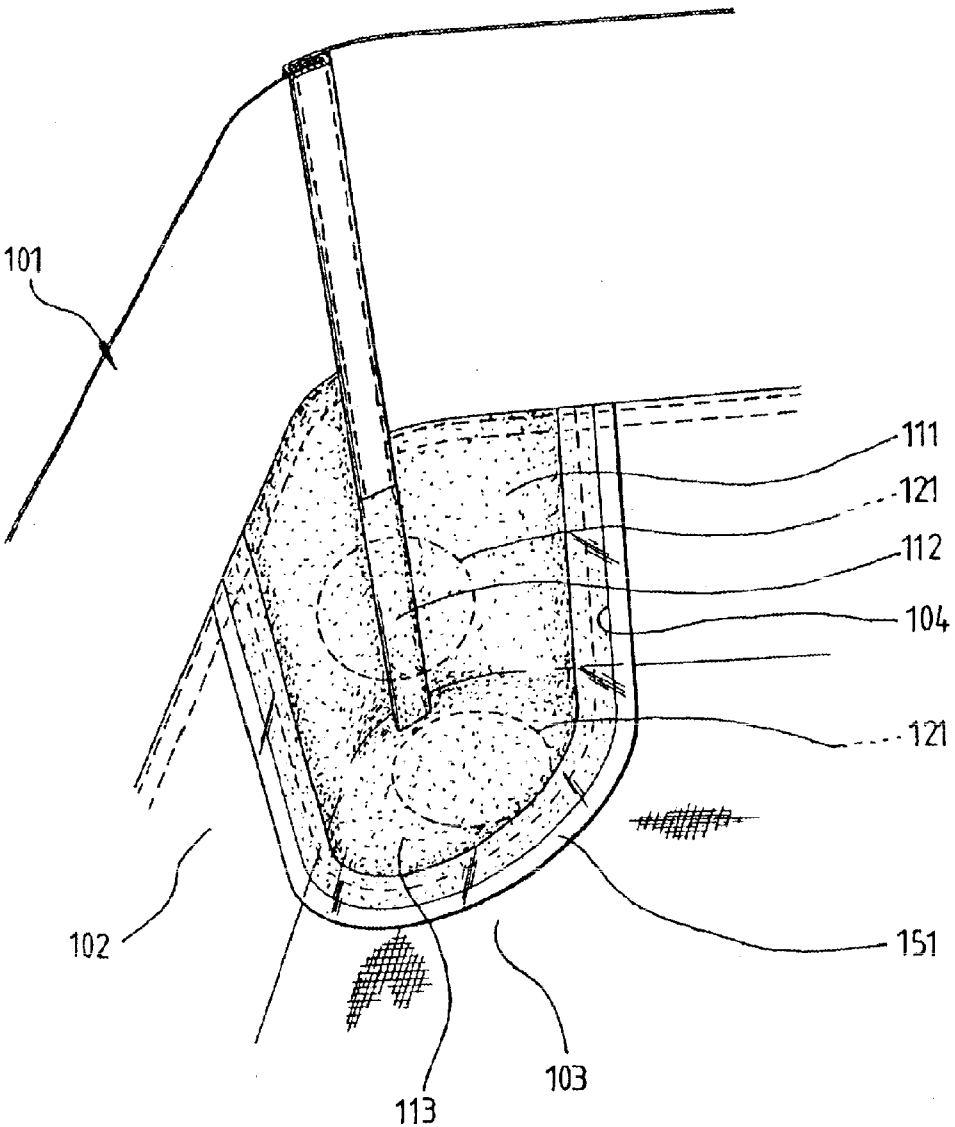
FIG. 8 is an internal perspective view showing the tent floor corner portion in view of the inside of the tent according to the present invention.

Furthermore, at the sewing line of the tarpaulin corner cloth 111 and cut hole 104, a seal tape 151 is sealed internally of the tent 101 as shown in FIG. 8, thus preventing the leakage of a sewn portion.

Hence, by attaching the corner cloth 111 of tarpaulin material with waterproof property to the corner portion formed by the fabric cloth sides 102 and the fabric cloth floor surface 103, a perfect waterproof effect can be obtained.

In addition, since a variety of peculiar designs can be presented by differentiating the color of the tarpaulin corner cloth 111 from that of the tent 101, a better-looking tent 101 can be devised Furthermore, a maximum waterproof effect can be obtained even if a minimum amount of an expensive tarpaulin corner cloth 111 was used.

Moreover, since the tent 101 can be manufactured at a low cost by using the minimum amount of the tarpaulin corner cloth 111, a superior economic efficiency can be acquired.

As seen from above, the waterproof structure of a tent floor corner portion of the present invention is advantageous in that it can obtain a perfect waterproof effect of a tent corner portion by forming cut holes by cutting away a plurality of corner portions formed by fabric cloth sides and a fabric cloth floor surface of a tent, connecting a tarpaulin corner cloth to the cut holes to be overlapped with each other, and attaching overlapped portions by sewing and heat-sealing a plurality of tarpaulin disc members sewn with a webbing tape to the tarpaulin corner cloth. It is also possible to thereby manufacture a better-looking tent by differentiating the color of the tarpaulin corner cloth and presenting a variety of peculiar designs, and a very good economic effect can be acquired by obtaining a maximum waterproof effect with a minimum amount of expensive tarpaulin cloth.

What is claimed is:

1. A waterproof structure of a tent floor corner portion, comprising:

a cut hole formed by cutting away a corner portion formed by fabric cloth sides and fabric cloth floor surface of a tent;

a tarpaulin corner cloth overlapping a peripheral portion of the cut hole with its overlapped portion being attached by sewing, said tarpaulin corner cloth including a heat seal portion being formed by folding of tarpaulin corner cloth to make two adjacent lateral sides that overlap with each other, the overlapped side portions being heat sealed together to form the heat seal portion; and a pair of tarpaulin disc members to which a webbing tape is sewn, said pair of tarpaulin disc members being heat-sealed with the tarpaulin corner cloth in order to attach the webbing tape which is connected with a loop.

2. The structure of claim 1, wherein the tarpaulin corner cloth comprises:

a straight type tarpaulin cloth of a band plate shape, the heat seal portion thereof forming a tarpaulin floor surface when folded.

3. The structure of claim 1, further comprising a seal tape along a sewing line connecting the tarpaulin corner cloth and the peripheral portion of the cut hole.

4. A waterproof structure of a tent floor corner portion, comprising:

a cut hole formed by cutting away a corner portion formed by fabric cloth sides and fabric cloth floor surface of a tent;

a tarpaulin corner cloth overlapping a peripheral portion of the cut hole with the overlapped portion being attached by sewing, said tarpaulin corner cloth including a heat seal portion being formed by folding of a straight type tarpaulin cloth of a band plate shape to make two adjacent lateral sides overlapped with each other and the overlapped lateral sides being heat sealed together to form the heat seal portion, a tarpaulin floor surface being formed by a part of the heat seal portion; and a pair of tarpaulin disc members to which a webbing tape is sewn, said pair tarpaulin disc members being heat-sealed with the tarpaulin corner cloth.

5. The structure of claim 4, further comprising a seal tape along a sewing line connecting the tarpaulin corner cloth and the peripheral portion of the cut hole.

* * * * *